US010638233B2

(12) United States Patent
Cao et al.

(10) Patent No.: US 10,638,233 B2
(45) Date of Patent: Apr. 28, 2020

(54) SPEAKER MODULE AND SOUND PRODUCTION DEVICE

(71) Applicant: Goertek Inc., Weifang, Shangdong (CN)

(72) Inventors: Huixian Cao, Weifang (CN); Xinfeng Yang, Weifang (CN); Guofu Wang, Weifang (CN); Shu Jiang, Weifang (CN); Huaisheng Zhang, Weifang (CN); Pengcheng Ji, Weifang (CN)

(73) Assignee: Goertek, Inc., Weifang (CN)

( * ) Notice: Subject to any disclaimer, the term of this patent is extended or adjusted under 35 U.S.C. 154(b) by 0 days.

(21) Appl. No.: 16/331,524

(22) PCT Filed: Feb. 10, 2017

(86) PCT No.: PCT/CN2017/073195
§ 371 (c)(1),
(2) Date: Mar. 7, 2019

(87) PCT Pub. No.: WO2018/045718
PCT Pub. Date: Mar. 15, 2018

(65) Prior Publication Data

US 2019/0208328 A1 Jul. 4, 2019

(30) Foreign Application Priority Data

Sep. 9, 2016 (CN) ..... 2016 2 1047836 U

(51) Int. Cl.
*H04R 9/06* (2006.01)
*H04R 19/02* (2006.01)
(Continued)

(52) U.S. Cl.
CPC ..... *H04R 9/06* (2013.01); *H04R 1/025* (2013.01); *H04R 7/04* (2013.01); *H04R 7/18* (2013.01);
(Continued)

(58) Field of Classification Search
None
See application file for complete search history.

(56) References Cited

U.S. PATENT DOCUMENTS

2002/0046900 A1* 4/2002 Abe ..... H04R 7/122 181/168
2016/0094917 A1 3/2016 Wilk et al.

FOREIGN PATENT DOCUMENTS

CN 204887445 U 12/2015
CN 205029868 U 2/2016
(Continued)

OTHER PUBLICATIONS

International Search Report of International Application No. PCT/CN2017/073195, dated Jun. 13, 2017 (5 pages).

*Primary Examiner* — Paul W Huber
(74) *Attorney, Agent, or Firm* — Patent Law Works LLP

(57) ABSTRACT

The present invention discloses a speaker module and a sound production device. The module comprises a module shell and a speaker unit mounted in the module shell. The module shell comprises a shell main body and two fixed pole plates connected fixedly on the shell main body. The two fixed pole plates are insulated from each other, and each of the two fixed pole plates has a connecting portion exposed to the outside of the shell main body. A vibration system of the speaker unit is provided with a movable pole plate, and each of the two fixed pole plates together with the movable pole plate form a variable capacitor. The speaker module is configured to output an electrical signal representing a vibration displacement of the vibration system by the connecting portions of the two fixed pole plates.

7 Claims, 5 Drawing Sheets

(51) Int. Cl.

| | |
|---|---|
| ***H04R 31/00*** | (2006.01) |
| ***H04R 9/02*** | (2006.01) |
| ***H04R 1/02*** | (2006.01) |
| ***H04R 7/04*** | (2006.01) |
| ***H04R 7/18*** | (2006.01) |
| ***H04R 29/00*** | (2006.01) |
| *H04R 7/10* | (2006.01) |
| *H04R 3/00* | (2006.01) |

(52) U.S. Cl.

CPC ..... *H04R 9/02* (2013.01); *H04R 19/02* (2013.01); *H04R 29/001* (2013.01); *H04R 31/003* (2013.01); *H04R 31/006* (2013.01); *H04R 1/021* (2013.01); *H04R 3/007* (2013.01); *H04R 7/10* (2013.01); *H04R 2307/027* (2013.01)

(56) References Cited

FOREIGN PATENT DOCUMENTS

| | | | |
|---|---|---|---|
| CN | 105681983 | A | 6/2016 |
| CN | 206136274 | U | 4/2017 |
| CN | 206136277 | U | 4/2017 |

* cited by examiner

SPEAKER MODULE AND SOUND PRODUCTION DEVICE

CROSS-REFERENCE TO RELATED APPLICATIONS

This application is a National Stage of International Application No. PCT/CN2017/073195, filed on Feb. 10, 2017, which claims priority to Chinese Patent Application No. 201621047836.8, filed on Sep. 9, 2016, both of which are hereby incorporated by reference in their entireties.

TECHNICAL FIELD

The present invention relates to the field of acoustic devices, and more particularly, the present invention relates to a speaker module and a sound production device provided with the same.

BACKGROUND

A speaker module comprises a module shell and a speaker unit mounted in the module shell. The most important structure of a moving coil structure as the speaker unit comprises a vibration diaphragm, a voice coil fixedly connected on the vibration diaphragm, and a magnetic circuit system. The voice coil is located in a magnetic gap formed in the magnetic circuit system. The speaker unit of such a structure drives the vibration diaphragm to vibrate under the action of the magnetic circuit system when the voice coil receives an audio signal, and the ambient air is stirred for sound production, so as to realize the conversion of electric energy to sound energy.

Such a speaker unit will limit the application of the maximum power of a product when working under low frequency conditions. The main problem is that under high power, the voice coil working under the low frequency conditions will generate an excessive displacement. The excessive displacement causes a sharp increase in distortion, and a noticeable collision between the voice coil and the magnetic circuit system is even caused, resulting in irreversible damage to the speaker.

For the above problem, the current solution is to use an intelligent power amplifier control unit to control the power fed to the speaker unit, so as to reduce the power when the vibration displacement of the vibration system exceeds a predetermined level, but it is required to know the vibration displacement of the vibration system.

In the prior art, a solution for detecting the vibration displacement is that the voice coil and an external circuit are used as a sensor, to realize the monitoring of the vibration displacement of the vibration system by the real-time measurement of a speaker model and the real-time monitoring of an input signal. The premise of such solution is the assumption that the speaker has a theoretical model, for example, a vibration diaphragm stiffness coefficient Kms, a vibration system mass Mms, a force electric drive factor Bl, a damping factor Rms, a DC impedance Re, an inductance Le, etc. However, there is still a certain difference between the theoretical speaker model and an actual product, which results in a limited monitoring accuracy of the displacement. The low-frequency performances of the speaker are restricted and the optimization of high-power performances of the speaker working under low-frequency conditions is affected.

Another solution for detecting the vibration displacement is to provide a fixed pole plate and a movable pole plate on the speaker unit, and the movable pole plate is located on the vibration diaphragm. In this way, the vibration displacement can be monitored by detecting the capacitance value of a variable capacitor formed by the fixed pole plate and the movable pole plate. Although the solution can improve the monitoring accuracy of the vibration displacement, a connecting structure capable of connecting the two pole plates to an external circuit needs to be added, for example, the lead arrangement of various forms, etc. This not only increases the structural complexity and the difficulty of processing and assembling processes of the speaker module, but also increases potential fault points.

SUMMARY

An object of the embodiments of the present invention is to provide a novel technical solution of a speaker module, to form a variable capacitor structure configured to monitor the vibration displacement and to be capable of being conveniently connected to an external circuit.

According to one aspect of the present invention, there is provided a speaker module, comprising a module shell and a speaker unit mounted in the module shell, wherein the module shell comprises a shell main body and two fixed pole plates connected fixedly on the shell main body, the two fixed pole plates are insulated from each other, and each of the two fixed pole plates has a connecting portion exposed to the outside of the shell main body; a vibration system of the speaker unit is provided with a movable pole plate, and each of the two fixed pole plates together with the movable pole plate form a variable capacitor; and the speaker module is configured to output an electrical signal representing a vibration displacement of the vibration system by the connecting portions of the two fixed pole plates.

Optionally, each of the fixed pole plates comprises a pole plate body and a metal body for welding that covers the pole plate body; and at least one part of the metal body is exposed to the outside of the shell main body as the connecting portion of the corresponding fixed pole plate.

Optionally, the two fixed pole plates are integrally molded from one material, and as the corresponding connecting portion, the surface of each of the fixed pole plates is directly exposed to the outside of the shell main body.

Optionally, each of the fixed pole plates comprises a pole plate body, and a terminal electrically connected to the pole plate body, and as the connecting portions of the corresponding fixed pole plates, the terminal is exposed to the outside of the shell main body.

Optionally, the two fixed pole plates are injection-molded on at least a part of the shell main body as inserts so as to be fixedly connected to the shell main body.

Optionally, an anti-disengagement limiting structure is provided between each of the fixed pole plates and the shell main body.

Optionally, the shell main body has openings in one-to-one correspondence with the two fixed pole plates, and the inner wall of each of the openings is provided with a step portion; and each of the fixed pole plates is embedded in the corresponding opening and is supported on the corresponding step portion.

Optionally, the movable pole plate is a reinforcing portion fixedly connected on the central plane portion of a vibration diaphragm of the vibration system, or is a film layer of the reinforcing portion fixedly connected on the central plane portion of the vibration diaphragm of the vibration system.

Optionally, a part of the vibration diaphragm corresponding to the reinforcing portion is cut to form a discharge opening, with an edge of the reinforcing portion overlapping the inner edge of the vibration diaphragm at the periphery of the discharge opening and being fixed thereon.

According to a second aspect of the present invention, there is provided a sound production device, comprising: a capacitance measuring circuit and the speaker module according to the first aspect of the present invention, wherein two signal input terminals of the capacitance measuring circuit and the two connecting portions of the speaker module are electrically connected in one to one correspondence.

One technical effect of the present invention is that according to the present invention, a serially-connected structure is formed by the two fixed pole plates provided on the module shell and the movable pole plate provided with the vibration system. In this way, the electrical signal representing the vibration displacement can be directly led by the connecting portions of the two fixed pole plates exposed to the outside. No connecting structure is required to be provided in the speaker module, thereby greatly reducing the structural complexity of the speaker module caused by forming the variable capacitor structure and leading the electrical signal generated by the capacitor structure, and further effectively reducing the process difficulty.

Other features and advantages of the present invention will become apparent through the detailed descriptions of the exemplary embodiments of the present invention with reference to the drawings.

BRIEF DESCRIPTION OF THE DRAWINGS

The drawings that constitute a part of the description show the embodiments of the present invention and are intended to explain the principle of the present invention together with the descriptions thereof.

DESCRIPTION OF THE REFERENCE SIGNS

1—module shell; 11—shell main body;
2—speaker unit; 21—vibration system;
211—movable pole plate; 22—magnetic circuit system;
31, 32—fixed pole plate; 301—pole plate body;
302—metal body; 303—terminal.

DETAILED DESCRIPTION

Now, various exemplary embodiments of the present invention will be described in detail with reference to the drawings. It should be noted that, unless specified otherwise, the relative arrangements of the members and steps, the mathematical formulas and numerical values described in these embodiments do not restrict the scope of the present invention.

The following descriptions for at least one embodiment are actually descriptive only, and shall not be interpreted as restrictions to the invention and any application or use thereof.

The techniques and devices well known to those skilled in the related arts may not be discussed in detail. However, where applicable, such techniques and devices should be deemed as a part of the description.

Any specific value shown herein and in all the examples should be interpreted as exemplary only rather than restrictive. Therefore, other examples of the exemplary embodiments may comprise different values.

It should be noted that similar signs and letters in the following drawings represent similar items. Therefore, once defined in one drawing, an item may not be further discussed in the followed drawings.

Figure 1:
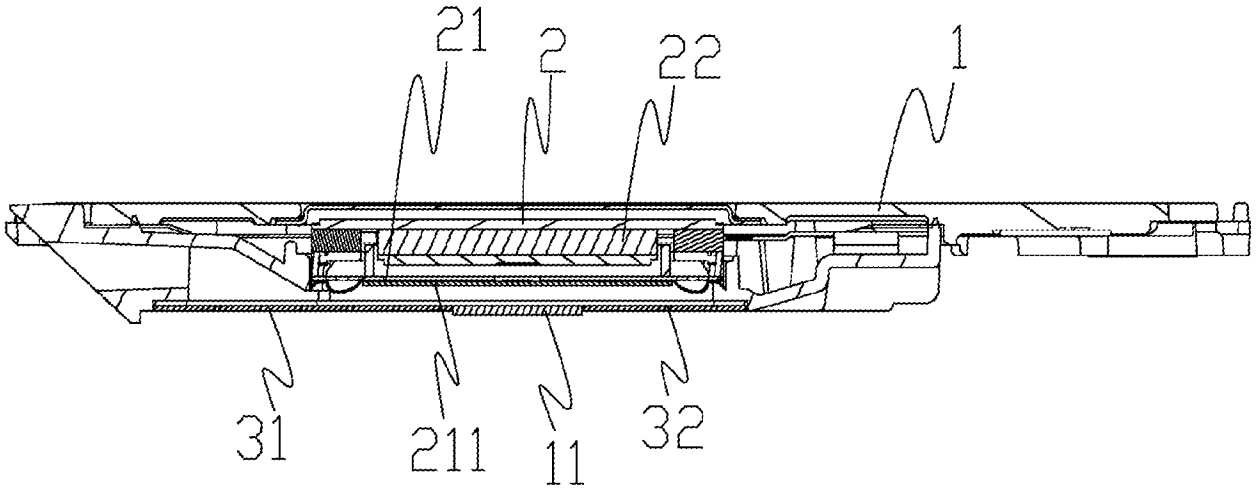
FIG. 1 is a schematic cross-sectional view of an embodiment of a speaker module according to the present invention.
Figure 2:
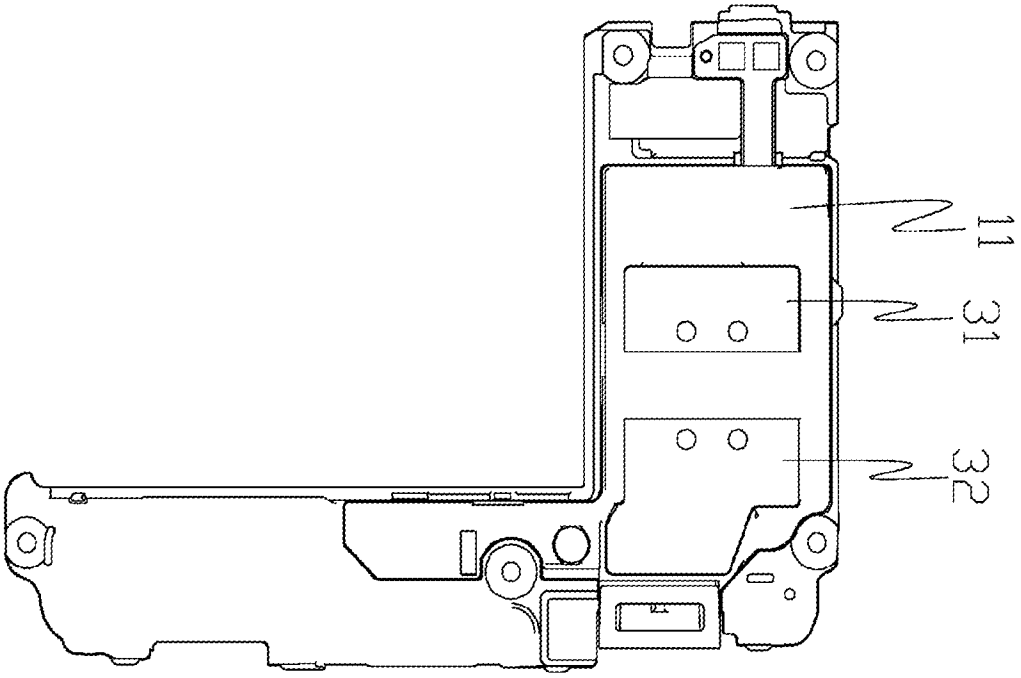
FIG. 2 is a schematic bottom view of the speaker module in FIG. 1.

FIG. 1 and FIG. 2 are schematic structural views of an embodiment of a speaker module according to the present invention.

According to FIG. 1 and FIG. 2, the speaker module comprises a module shell 1, and a speaker unit 2 mounted in the module shell 1.

The vibration system 21 further comprises a vibration diaphragm and a voice coil, and may further comprise a reinforcing portion (DOME) fixedly connected to the central plane portion of the vibration diaphragm. The voice coil may be fixedly connected on the vibration diaphragm or may be fixedly connected on the reinforcing portion, and is located in the magnetic gap formed in a magnetic circuit system 22.

In the embodiment in which the vibration system 21 is provided with the reinforcing portion, the part of the vibration diaphragm corresponding to the reinforcing portion may be cut to form a discharge opening, with an edge of the reinforcing portion overlapping the inner edge of the vibration diaphragm on the periphery of the discharge opening and being fixed thereon, so as to reduce the load of the vibration system 21.

In the embodiment shown in FIG. 1, the magnetic circuit system 22 is a dual-magnetic circuit structure, that is, the magnetic circuit system comprises a magnetically permeable yoke, a central magnet fixedly connected on the magnetically permeable yoke, a side magnet provided around the central magnet on the magnetically permeable yoke, a magnetically permeable central plate fixedly connected on the center magnet, and a magnetically permeable side plate fixedly connected on the side magnet. The above magnetic gap is formed between the magnetically permeable central plate and the magnetically permeable side plate. The side magnet may be a ring-shaped magnet or may consist of a plurality of separate magnets.

In other embodiments, the magnetic circuit system 22 may also adopt a single-magnetic circuit structure, for example an inner magnetic circuit structure and an outer magnetic circuit structure. The inner magnetic circuit structure, that is, the magnetic circuit system 22, comprises a bowl-shaped magnetically permeable yoke, a central magnet fixedly connected on the magnetically permeable yoke, and a magnetically permeable central plate fixedly connected on the central magnet. The above magnetic gap is formed between the magnetically permeable central plate and the side wall of the magnetically permeable yoke.

The module shell 1 comprises a shell main body 11 and two fixed pole plates 31, 32 fixedly connected on the shell main body 11. The two fixed pole plates 31, 32 are insulated from each other. Each of the two fixed pole plates 31, 32 has a connecting portion exposed to the outside of the shell main body 11 to facilitate the connection between the two fixed pole plates 31, 32 and an external circuit.

In order to facilitate the mounting of the speaker unit 2, the shell main body 11 may comprise at least two parts assembled together. In the embodiment shown in FIG. 1 and FIG. 2, the shell main body 11 comprises a module upper shell and a module lower shell. The two fixed pole plates 31, 32 are specifically fixedly connected on the module upper shell. The module upper shell is defined as a shell facing the side of the vibration diaphragm, and the module lower shell is defined as a shell facing the side of the magnetic circuit system.

In one specific embodiment of the present invention, the two fixed pole plates 31, 32 may be injection-molded on at least part of the shell main body 11 as inserts to be fixedly connected to the shell main body 11. In the embodiment shown in FIG. 1 and FIG. 2, the two fixed pole plates 31, 32 are injection-molded on the module upper shell as the inserts to be fixedly connected to the shell main body 11, that is, during the injection molding of the module upper shell, the two fixed pole plates 31, 32 are placed at corresponding positions of the cavity of an injection mold as the inserts, and are positioned. Hence, injection molding raw materials can be injected into the injection mold, and then the injection molding of the module upper shell can be performed on the fixed pole plates 31, 32, so that the two are reliably combined. Such combination structure has the advantages that the bonding force is high, the fixation between the two can be realized without additional means, effective anti-disengagement limiting structures can be provided between the two, convenience in processing and low cost are realized, and the like.

The limiting structures are, for example, at least a pair of anti-disengagement acting surfaces between the fixed pole plates 31 and 32 and the shell main body 11 so that the corresponding limiting structures are formed. The acting surfaces are stepped surfaces, inclined surfaces, or the like.

In another specific embodiment of the present invention, the two fixed pole plates 31, 32 may also be adhesively fixed on the shell main body 11. For example, the two fixed pole plates 31, 32 may be adhesively fixed in corresponding openings of the shell main body 11, or may be adhesively fixed on the parts of the shell main body at the peripheries of the corresponding openings at the inner side of the shell main body 11, or may be adhesively fixed on the parts of the shell main body at the peripheries of the corresponding openings at the outer side of the shell main body 11.

In the embodiment in which the two fixed pole plates 31, 32 are adhesively fixed on the parts of the shell main body at the peripheries of the corresponding openings at the outer side of the shell main body 11, each of the fixed pole plates 31, 32 may comprise an intermediate portion and a basin edge formed by extending and bending the intermediate portion. The intermediate portion of each of the fixed pole plates 31, 32 is embedded in the corresponding opening or extends into the shell main body 11 via the corresponding opening. The basin edge of each of the fixed pole plates 31, 32 is lapped and fixed on the shell main body 11, so as to reduce the initial gap between the fixed pole plates 31, 32 and a movable pole plate 211 as much as possible, and increase an electrical signal.

In order to facilitate the positioning of the fixed pole plates 31, 32 on the shell main body 11, in a specific embodiment of the present invention, the shell main body 11 may have the openings in one-to-one correspondence with the two fixed pole plates 31, 32. The inner wall of each opening is provided with a step portion. Each of the fixed pole plates 31, 32 is embedded in the corresponding opening and supported on the step portion. On such basis, in combination with the embodiment of adhesive fixing, the two fixed pole plates 31, 32 can be adhesively fixed on the corresponding step portions directly.

In the embodiment in which the shell main body 11 is made of an insulating material such as plastic, by disposing the two fixed pole plates 31, 32 on the shell main body 11 at an interval, the insulation therebetween can be achieved by the shell main body 11.

In the embodiment in which the two fixed pole plates 31, 32 are fixed on the shell main body 11 by insulating cement, the insulation therebetween can also be achieved by the insulating cement and/or the shell main body.

The vibration system 21 is provided with the movable pole plate 211, wherein a formation structure of the movable pole plate 211 may be the following but is not limited thereto.

1. The vibration diaphragm is made of a metal material, and the vibration diaphragm is used as the movable pole plate 211.

2. The vibration diaphragm is made of an insulating material, and a metal film layer is combined on the vibration diaphragm as the movable pole plate 211 by means of surface deposition, surface evaporation, adhering, or the like. In the present embodiment, the movable pole plate 211 may be regarded as a film layer of the vibration diaphragm, that is, a complex vibration diaphragm is formed.

3. A reinforcing portion made of a metal material is fixedly connected on the vibration diaphragm, and the reinforcing portion is used as the movable pole plate 211.

4. A reinforcing portion is fixedly connected on the vibration diaphragm, the reinforcing portion is of a complex film structure, and the reinforcing portion has a metal film layer as the movable pole plate.

According to the speaker module of the present invention, each of the two fixed pole plates 31, 32 together with the movable pole plate 211 form a variable capacitor, that is, two variable capacitors are formed, and the movable pole plate 211 is shared by two variable capacitors to form a serially connected structure. In this way, the speaker module can output the electrical signal representing the vibration displacement of the vibration system by the connecting portions of the two fixed pole plates 31, 32. Herein, since the two fixed pole plates 31, 32 are provided on the shell main body 11, their respective connecting portions are very easy to form. Besides, the structural design in which the respective connecting portions are exposed to the outside is also very easy to realize, and the difficulty of processing and assembling is not increased, thereby greatly reducing the structural complexity and the process difficulty.

Figure 5:
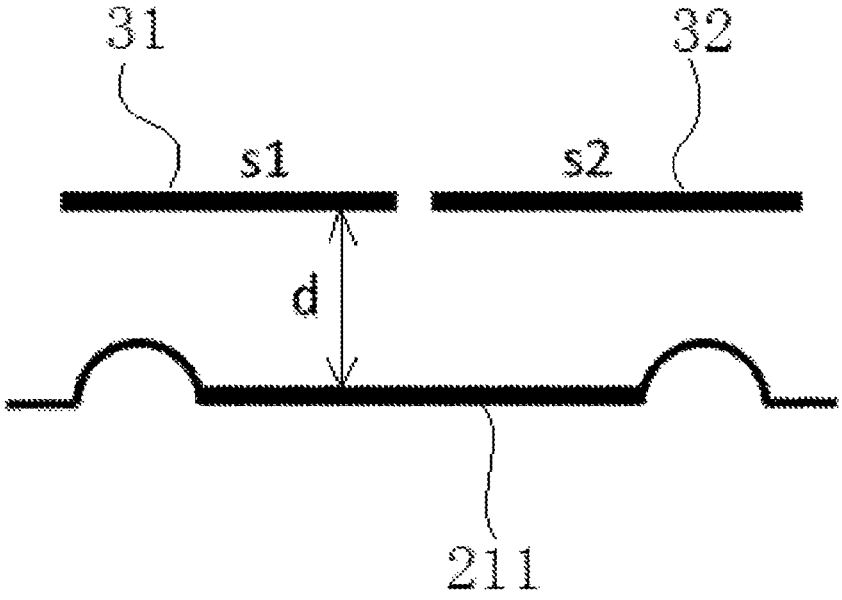
FIG. 5 is a simplified schematic view of a variable capacitor structure formed by the speaker module in FIG. 1.

FIG. 5 is a simplified schematic diagram of a variable capacitor structure formed by the speaker module in FIG. 1. The principle of outputting the electrical signal representing the vibration displacement of the vibration system by such a variable capacitor structure will be described below with reference to FIG. 5.

It is assumed that the initial capacitance between the fixed pole plate 31 and the movable pole plate 211 is C13, and the effective area between the two is S1; the initial capacitance between the fixed pole plate 32 and the movable pole plate 211 is C23, and the effective area between the two is S2; the initial capacitance between the fixed pole plate 31 and the fixed pole plate 32 is C12; the initial interval between the fixed pole plates 31, 32 and the movable pole plate 211 is equal, and is d; ε is a dielectric constant; the displacement of the vibration system is Δd, after the vibration system is moved by Δd, the capacitance between the fixed pole plate 31 and the fixed pole plate 32 is C12'.

Thus, it is concluded that $$C13 = \frac{\varepsilon S1}{d},\ C23 = \frac{\varepsilon S2}{d}.$$

Since C13 and C23 are serially connected, $$C12 = \frac{C23C13}{C23 + C13} = \frac{\varepsilon S1S2}{(S1 + S2)d};$$

similarly, $$C12' = \frac{\varepsilon S1S2}{(S1 + S2)(d + \Delta d)},$$

and further, $$\frac{C12}{C12'} = \frac{d + \Delta d}{d}.$$

In the case where d and C12 are known, Δd can be calculated by measuring the electrical signal C12'.

Figure 3:
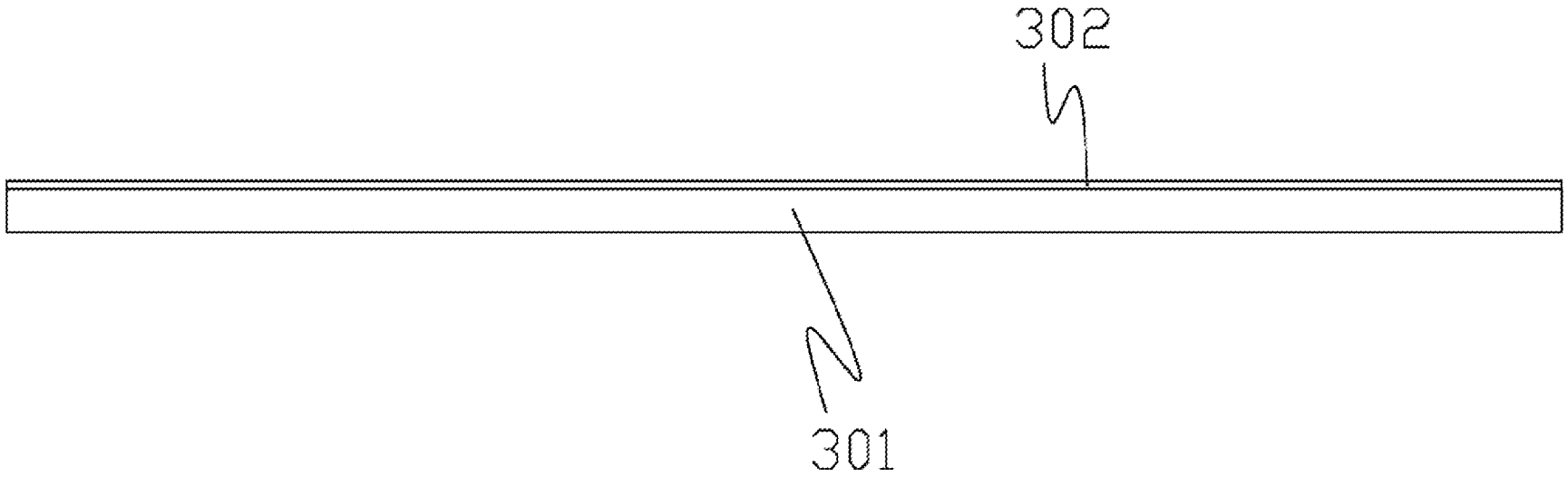
FIG. 3 is a schematic structural view of an embodiment of a fixed pole plate in FIG. 1.

FIG. 3 is a schematic structural view of an embodiment of the fixed pole plates in FIG. 1 and FIG. 2.

As shown in FIG. 3, by taking the fixed pole plate 31 as an example, the fixed pole plate 31 comprises a pole plate body 301 and a metal body 302 for welding that covers the plate body 301. The metal body 302 is made of, for example tin or gold, which is advantageous for welding. At least a part of the metal body 302 is exposed to the outside as the connecting portion of the fixed pole plate 31. For example, the metal body 302 can be completely exposed to the outside to increase the surface area available for connection. The pole plate body 301 is the part of the fixed pole plate 31 that together with the movable pole plate 211 form the variable capacitor.

The metal body may cover the pole plate body 301 by, for example, plating.

The metal body may completely cover one surface of the pole plate body 301 or may partially cover one surface of the pole plate body 301.

For the present embodiment, when the connection between the speaker module and an external capacitance measuring circuit is performed, the two signal input terminals of the capacitance measuring circuit may be wires, pins, or the like, which are welded on the connecting portions of the corresponding fixed pole plates 31, 32, and may also be elastic pieces, springs, or the like which are directly pressed against the connecting portions of the corresponding fixed pole plates 31 and 32 to achieve contact electrical connection. Therefore, the present embodiment has high compatibility with the connection mode and can be matched with substantially all forms of signal input terminals.

The present embodiment can be applied to the case where a material of the pole plate body 301 cannot be reliably connected by welding. For example, the pole plate body 301 is a steel sheet.

The fixed pole plate 32 may be provided with reference to the fixed pole plate 31.

Figure 4:
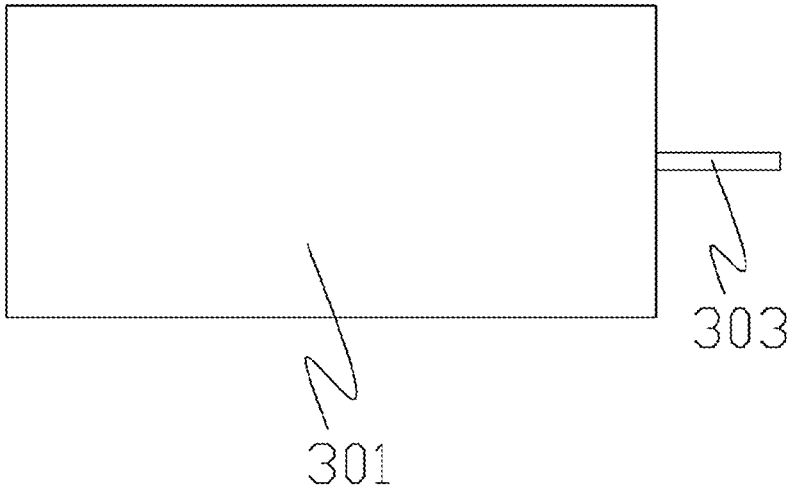
FIG. 4 is a schematic structural view of another embodiment of the fixed pole plate in FIG. 1.

FIG. 4 is a schematic structural view of another embodiment of the fixed pole plate in FIG. 1 and FIG. 2.

As shown in FIG. 4, the fixed pole plate 31 is also taken as an example. The fixed pole plate 31 comprises a pole plate body 301 and a terminal 303 electrically connected to the pole plate body 301. As the connecting portion of the fixed pole plate 31, the terminal 303 is exposed to the outside of the shell main body 11.

The terminal 303 extends outwardly, for example, via the edge of the pole plate body 301.

The present embodiment can also be applied to the case where the material of the pole plate body 301 cannot be reliably connected by welding. For example, the pole plate body 301 is a steel sheet. Thus, the terminal 303 may comprise a steel body integrally molded with the pole plate body 301, and a metal body for welding that covers the steel body. The metal body is made of, for example, tin or gold which is advantageous for welding.

The metal body may cover the surface of the steel body by, for example, plating. Since the terminal 303 has a smaller area relative to the pole plate body 301, such a structure is advantageous in cost control.

In addition, the whole terminal 303 may also be made of metal suitable for welding.

For the present embodiment, when the connection between the speaker module and the external capacitance measuring circuit is performed, the two signal input terminals of the capacitance measuring circuit may be wires, pins, or the like which are welded on the corresponding connecting portions of the fixed pole plates 31, 32, and may also be elastic pieces, springs, or the like which are directly pressed against the connecting portions of the corresponding fixed pole plates 31 and 32 to achieve contact electrical connection.

The fixed pole plate 32 can be provided with reference to the fixed pole plate 31.

In a further embodiment, the fixed pole plates 31, 32 are integrally molded from one material, and as the connecting portions, the surfaces thereof are directly exposed to the outside. In the present embodiment, if the fixed pole plates 31, 32 are the pole plates such as steel sheets which cannot be reliably connected by welding, the mainly applicable signal input terminals are the terminal structures such as elastic pieces or springs, which implement contacting electrical connection by direct pressing.

In addition to the function of forming the variable capacitor together with the movable pole plate, the above use of the steel sheet as the pole plate body 301 or as the fixed pole plates 31, 32 is also advantageous for reducing the thickness of the module shell 1, so as to ensure the lightweight and thin design under the premise of ensuring module performances.

According to another aspect of the present invention, there is also provided a sound production device, comprising the above capacitance measuring circuit, and the speaker module according to the present invention. Two signal input terminals of the capacitance measuring circuit and the two connecting portions of the speaker module are electrically connected in one-to-one correspondence in any one of the above connecting structures.

Although specific embodiments of the present invention are described in detail through some examples, those skilled in the art shall understand that the above examples are illustrative only and are not intended to limit the scope of the present invention, that modifications can be made to the above embodiments without departing from the scope and spirit of the present invention, and that the scope of the present invention is defined by the appended claims.

The invention claimed is:

1. A speaker module, comprising:

a module shell and;

a speaker unit mounted in the module shell, wherein:

the module shell comprises:

a shell main body; and two fixed pole plates connected fixedly on the shell main body, wherein:

the two fixed pole plates are insulated from each other;

each fixed pole plate of the two fixed pole plates has a connecting portion exposed to the outside of the shell main body;

each fixed pole plate of the two fixed pole plates comprises a pole plate body and a metal body for welding that covers the pole plate body; and at least a portion of the metal body is exposed to the outside of the shell main body as the connecting portion of that fixed pole plate; and a vibration system of the speaker unit is provided with a movable pole plate, wherein each of the two fixed pole plates together with the movable pole plate form a variable capacitor; and the speaker module is configured to output an electrical signal representing a vibration displacement of the vibration system by the connecting portion of each of the two fixed pole plates.

2. The speaker module according to claim 1, wherein the two fixed pole plates are integrally molded from one material, and as the corresponding connecting portion, a surface of each of the fixed pole plates is directly exposed to the outside of the shell main body.

3. The speaker module according to claim 1, wherein each fixed pole plate of the two fixed pole plates comprises a terminal electrically connected to the pole plate body of the fixed pole plate, and as the connecting portion, the terminal is exposed to the outside of the shell main body.

4. The speaker module according to claim 1, wherein the two fixed pole plates are injection-molded on at least a part of the shell main body as inserts so as to be fixedly connected to the shell main body.

5. The speaker module according to claim 4, wherein an anti-disengagement limiting structure is provided between each fixed pole plate of the two fixed pole plates and the shell main body.

6. The speaker module according to claim 1, wherein the shell main body has openings in one-to-one correspondence with the two fixed pole plates;

an inner wall of each opening of the openings is provided with a step portion; and each fixed pole plate of the two fixed pole plates is embedded in the corresponding opening and is supported on the corresponding step portion.

7. A sound production device, comprising: a capacitance measuring circuit and the speaker module according to claim 1, wherein two signal input terminals of the capacitance measuring circuit and the two connecting portions of the speaker module are electrically connected in one to one correspondence.

* * * * *